US005667890A

United States Patent [19]

Ballard et al.

[11] Patent Number: 5,667,890

[45] Date of Patent: Sep. 16, 1997

[54] MONOFILAMENTS EXTRUDED FROM COMPATIBILIZED POLYMER BLENDS CONTAINING POLYPHENYLENE SULFIDE, AND FABRICS THEREOF

[75] Inventors: Larry E. Ballard; Marc R. Savoy, both of Columbia, S.C.

[73] Assignee: Shakespeare Company, Columbia, S.C.

[21] Appl. No.: 626,492

[22] Filed: Apr. 2, 1996

[51] Int. Cl.[6] ..... D02G 3/00

[52] U.S. Cl. ..... 428/364; 428/373

[58] Field of Search ..... 428/364, 373; 525/64, 66, 67, 71, 73, 390, 391, 537, 436

[56] References Cited

U.S. PATENT DOCUMENTS

| | | | |
|---|---|---|---|
| 4,305,865 | 12/1981 | Okada et al. | 260/42.18 |
| 4,528,335 | 7/1985 | Selby et al. | 525/420 |
| 4,610,916 | 9/1986 | Ballard | 428/224 |
| 4,786,554 | 11/1988 | Baker et al. | 428/364 |
| 4,801,492 | 1/1989 | Skinner et al. | 428/224 |
| 4,806,407 | 2/1989 | Skinner et al. | 428/224 |
| 5,214,083 | 5/1993 | Kodaira et al. | 524/95 |
| 5,225,270 | 7/1993 | Bhoori et al. | 428/364 |
| 5,332,780 | 7/1994 | Kitazai | 526/307.1 |
| 5,369,171 | 11/1994 | Mulhaupht et al. | 525/184 |
| 5,424,125 | 6/1995 | Ballard et al. | 428/364 |

FOREIGN PATENT DOCUMENTS

| | | | |
|---|---|---|---|
| 0 361 636 A2 | 4/1990 | European Pat. Off. | C08L 77/00 |
| 0 489 437 A2 | 6/1992 | European Pat. Off. | C08L 77/10 |
| WO86/03212 | 6/1986 | WIPO | C08L 77/00 |

OTHER PUBLICATIONS

"Phase Morphology and Mechanical Properties of Blends of Poly(p–Phenylene Sulfide) and Polyamides" by Akhtar et al., *Polymer Engineering and Science* vol. 32, No. 10, pp. 690–698 (May 1992).

*Primary Examiner*—Newton Edwards

*Attorney, Agent, or Firm*—Renner, Kenner, Greive, Bobak, Taylor & Weber

[57] ABSTRACT

An extruded monofilament is formed from a compatibilized blend of polyphenylene sulfide and a polyamide resin. The blend is compatibilized by the addition of a compatibilizing resin selected from the group consisting of chemically modified and functionalized polyolefins. Preferably, from about 25 to about 99 parts by weight of a polyphenylene sulfide resin and from about 75 to 1 parts by weight of at least one polyamide resin, together with from about 0.1 to 10 parts by weight of a compatibilizer are blended and extruded to form the monofilament. The resultant monofilament exhibits improved physical properties as compared to unblended polyphenylene sulfide resins (PPS), as well as uncompatibilized blends of PPS with other materials. The monofilaments prepared from these compatibilized blends are useful as components of industrial fabrics, particularly fabrics such as are used as belts on paper forming machines. The polymer blend and a process for the manufacture of the monofilaments are also provided.

7 Claims, 1 Drawing Sheet

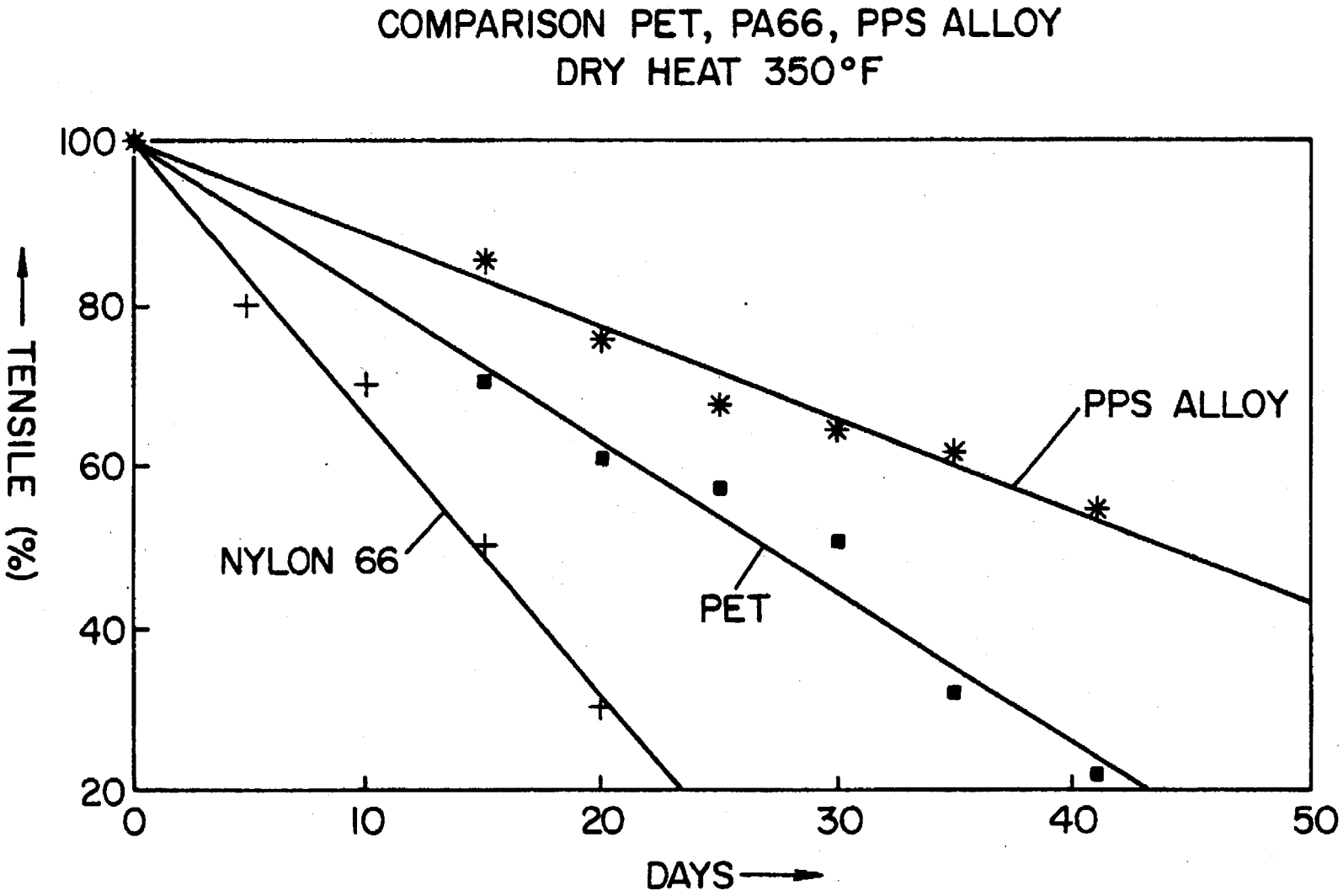
COMPARISON PET, PA66, PPS ALLOY
DRY HEAT 350°F
PPS ALLOY
PET
NYLON 66
TENSILE (%)
100
80
60
40
20
0
10
20
30
40
50
DAYS

MONOFILAMENTS EXTRUDED FROM COMPATIBILIZED POLYMER BLENDS CONTAINING POLYPHENYLENE SULFIDE, AND FABRICS THEREOF

TECHNICAL FIELD

The present invention relates generally to monofilaments prepared using conventional extrusion techniques and the polymer blend from which the monofilament is extruded. More particularly, the present invention relates to an extruded monofilament comprising a compatibilized blend of polyphenylene sulfide (PPS) and polyamide. The blend is compatibilized by the addition of a third resin, a compatibilizer, which enables the blended monofilament to exhibit improved physical properties as compared to monofilaments of unblended resins as well as uncompatibilized blends of PPS with other materials. The monofilaments prepared from these compatibilized blends are useful as components of industrial fabrics, particularly fabrics such as are used as belts on paper forming machines. A process for the manufacture of such monofilaments is also provided.

BACKGROUND OF THE INVENTION

Polyphenylene sulfide has outstanding chemical and thermal resistance and, therefore, monofilaments thereof are currently used in many industrial applications. For example, fabrics prepared from monofilaments of PPS are currently used on paper forming machines. Because of the harsh chemical and thermal environment in which these fabrics are used, fabrics of PPS have extended life and better overall performance than fabrics composed of monofilaments of conventional materials such as polyethylene terephthalate (PET) and polyamides.

However, PPS is limited to some extent in its applications because it is a brittle material. Filaments of PPS have lower tensile and loop strength than do filaments of conventional materials, e.g., PET and polyamides. PPS filaments also have somewhat poor abrasion resistance compared to filaments of PET and polyamide.

For these reasons, filaments composed of blends of PPS with other materials have been made and have been woven into fabrics for use on paper forming machines and for other applications. However, while certain physical properties were improved with the addition of a second polymeric material, oftentimes other properties would not be suitably improved and, in some instances, would be undesirably affected by the use of the second material. In fact, in some instances, certain constraining limits had to be placed on how the resultant blend was used, and in many, if not all, instances, it was necessary to make the blend before one could even consider extruding the blend, if extrusion was even possible.

For example, in Selby et al. U.S. Pat. No. 4,528,335, uncompatibilized blends of molding grade PPS having a melt flow, as determined by ASTM D1238 (600° F., 5 kg weight) of 20–65 gm per 10 minutes, and amorphous polyamides were prepared in order to improve the impact strength and shrinkage of PPS resins. The blends were injection molded rather than extruded. Blends of PPS and crystalline polyamides were not satisfactory with respect to shrinkage and warpage. Blends prepared for injection molding would not be expected to be as intimately blended as would be blends used for extruding filaments.

In Ballard U.S. Pat No. 4,610,916, filaments were made from blends of PPS and a halogenated polyolefin. This particular blend acted to reduce the brittleness of the filament. These blended materials are not compatible, however, and the physical properties, such as tensile strength, abrasion resistance and knot strength were not significantly improved over unblended filaments of other conventional materials.

In Skinner et al. U.S. Pat. No. 4,748,077, filaments were made from uncompatibilized blends of PPS and polyolefins. Tensile strength and abrasion resistance of filaments comprising the blends were reduced, but other properties were not significantly improved over filaments containing unblended PPS.

In Baker et al. U.S. Pat. No. 4,786,554, filaments made from blends of PPS with heat stabilized nylon 66 were prepared. These blends were not compatibilized and were limited to blends containing no more than about 20% nylon 66. Filaments produced from blends of PPS and type 66 nylon had decreased abrasion resistance at elevated levels of the polyamide.

Skinner et al. U.S. Pat. No. 4,801,492 teaches uncompatibilized blends of PPS and ionomers. The physical properties of the blends are not significantly improved compared to the unblended resins.

Skinner et al. U.S. Pat. No. 4,806,407 teaches uncompatibilized blends of PPS and polyolefins, blends of PPS and halogenated homopolymers and blend of PPS and aromatic aliphatic polyamides. Again, the physical properties of the blends were not significantly improved compared to the unblended PPS.

Kodaira et al. U.S. Pat. No. 5,214,083 is directed toward blends of PPS with poly(phenylene ether) and copolymers of nylon 6 and nylon 12 and/or nylon 6/36. The composition contains compatibilizers which include various monomeric substances or polymers having epoxy groups and/or oxazolinyl groups. However, these compatibilizing polymers are not suitable for use in extrusion processes like those used in the present invention. Instead, the compositions are prepared by melt kneading techniques. In general, at least three kneading steps are required prior to an injection molding step. The blended material results in improved impact resistance of molded resins containing the PPS, poly(phenylene ethers) and the polyamides.

In Ballard et al. U.S. Pat. No. 5,456,973, filaments were made from blends of PPS and PET without the use of compatibilizers. The patent also teaches blends prepared from PPS, PET and high temperature polyester and polyphenylene oxide.

International Publication No. WO 86/03212 teaches uncompatibilized blends of PPS and nylon 46 or copolymers of 46. Nylon 46 was found to be miscible with PPS; however, nylon 6 and nylon 66 were found to be insufficiently compatible with PPS for homogeneous blends to be prepared. The blends were prepared by melting, kneading and pelletizing the resins. The blends were used to prepare injection molded parts but were not extruded.

European Pat. No. 0 489 437 A2 teaches uncompatibilized blends of PPS and aromatic polyamides. Such blends were prepared by kneading in a twin screw extruder, followed by pelletization. The blends were characterized as having heat resistance superior to that of the aliphatic polyamides.

European Pat. No. 0 361 636 A2 is directed toward uncompatibilized blends of PPS and aromatic polyamides with glass fibers. The blends have improved heat deflection temperatures.

Also, Akhtar and White, in "Phase Morphology and Mechanical Properties of Blends of Poly(p-Phenylene Sulfide) and Polyamides", *Polymer Engineering and*

*Science*, 32, 690 (May 1992), dicusss blends of PPS and various polyamides. Uncompatibilized blends were prepared by mixing the components and blending the mixture using a twin screw extruder. The blends were molded and tested. It was found that blends of semi-crystalline, aliphatic polyamides had very poor mechanical properties, viz., low tensile strength and elongation to break. They were not tough and generally had poor values of impact strength. Phase morphology studies revealed the lack of interfacial adhesion between the PPS phase and the polyamide phase.

Thus, the need exists for compatibilized blends of PPS and other materials such as one or more polyamide resins which blends, because they are compatibilized, have improved mechanical/physical properties as compared to previous blends of PPS and other materials which blends were not completely compatibilized. The need further exists from such compatibilized polymer blends which can be extruded as filaments such that the extruded monofilament thereof provide improved hydrolytic, thermal, chemical and physical properties as compared to monofilaments of unblended PPS, unblended polyamide resins, and/or PPS with other conventional materials.

As noted above in several references, polyamides provide many of the desirable properties not found in PPS. That is, polyamides exhibit excellent mechanical properties such as high tensile strength and loop strength. However, polyamides are susceptible to degradation under wet or dry, high temperature conditions and to harsh chemical environments such as high or low pH and to environments containing chlorine or peroxides. Polyamide filaments also absorb water which results in poor dimensional stability. For example, fabrics woven from polyamide filaments used on paper making machines will often lengthen when exposed to wet environments. The change in length of the monofilaments and fabrics in this situation, therefore, requires adjustments to be made to the equipment and is considered undesirable.

Thus, it would be desirable to provide a monofilament which maintains or improves the excellent mechanical properties exhibited by polyamides, but which will not, inter alia, excessively change in length when exposed to wet environments or degrade quickly under extreme thermal conditions. Such filaments could then be used for making fabrics which may be exposed to wet, high temperature conditions without concern that the fabrics will change dimensions or degrade rapidly.

SUMMARY OF INVENTION

It is, therefore, an object of this invention to provide a compatibilized polymer blend of polyphenylene sulfide and at least one polyamide resin with the addition of a compatibilizer.

It is another object of the present invention to provide a monofilament which can be extruded from the compatibilized polymer blends of PPS and one or more polyamide resins.

It is yet another object of the present inventions to provide a monofilament comprising a compatibilized blend of PPS and one or more polyamide resins which monofilament has useful hydrolytic, thermal, chemical and physical properties.

It is still another object of the present invention to provide a monofilament, as above, which has properties which are superior to monofilaments comprising 100 percent PPS, 100 percent polyamide resin, or even an uncompatibilized blend of PPS and an additional material such as nylon.

It is a further object of the present invention to provide a fabric which is at least partially woven from monofilaments formed from a compatibilized blend of PPS and one or more polyamide resins.

It is yet a further object of the present invention to provide a method for preparing a monofilament from a compatibilized blend of PPS and a polyamide resin.

At least one or more of these objects, together with the advantages thereof over existing monofilaments and products thereof, which shall become apparent from the specification which follows, are accomplished by the invention as hereinafter described and claimed.

In general, the present invention provides an extruded monofilament formed by a compatibilized blend comprising from about 25 to about 99 parts by weight of a polyphenylene sulfide, from about 75 to about 1 parts by weight of a polyamide, and from about 0.1 to about 10 parts by weight of a compatibilizer, wherein the compatibilizer is selected from the group consisting of chemically modified and functionalized polyolefins.

Other aspects or objects of the present invention are achieved by providing a fabric at least partially containing a plurality of monofilaments formed from a compatibilized blend of polyphenylene sulfide and polyamide, the plurality of monofilaments more particularly including from about 25 to about 99 parts by weight polyphenylene sulfide, from about 75 to about 1 parts by weight polyamide, and from about 0.1 to about 10 parts by weight of a compatibilizer, wherein the compatibilizer is selected from the group consisting of chemically modified and functionalized polyolefins.

Still other aspects and objects of the present invention are achieved by the process for making the monofilament of the present invention, which includes the step of extruding a blend of from about 25 to about 99 parts by weight of a polyphenylene sulfide, from about 75 to about 1 parts by weight of a polyamide, and from about 0.1 to about 10 parts by weight of a compatibilizer selected from the group consisting of chemically modified and functionalized polyolefins to form the monofilament. Thereafter, the monofilament may be drawn between draw rolls to a ratio of from about 3:1 to 6:1.

Yet other aspects and objects are achieved by providing a compatibilized polymer blend comprising from about 25 to about 99 parts by weight of a polyphenylene sulfide; from about 75 to about 1 parts by weight of at least one polyamide resin; and from about 0.1 to about 10 parts by weight of a compatibilizer selected from the group consisting of chemically modified and functionalized polyolefins.

BRIEF DESCRIPTION OF THE DRAWINGS

The FIGURE is a graph drawing comparing the dry heat stability (percent tensile retention over a number of days) of a monofilament of the present invention with monofilaments of unblended, 100 percent PET and unblended, 100 percent nylon 66.

PREFERRED EMBODIMENT FOR CARRYING OUT THE INVENTION

The present invention is directed toward compatibilized polymer blends of polyphenylene sulfide (PPS) and at least one polyamide resin, e.g., nylon, and more particularly, toward monofilaments comprising the compatibilized blends. The compatibilized blends have improved thermal and mechanical properties such as impact strength as compared to uncompatibilized blends of these polymeric materials, while the monofilaments thereof have improved tensile strength, loop impact strength, abrasion resistance and loop strength compared to unblended PPS filaments as well as dry heat and hydrolysis resistance and improved wet strength properties compared to polyamide filaments. In fact, filaments prepared according to the concepts of the present invention have improved properties as compared to filaments of uncompatibilized blends of PPS and other polymeric materials, including nylon.

As noted herein above, PPS exhibits excellent high temperature stability and chemical resistance which makes it ideal for use in high pH or low pH, high temperature applications in harsh environments. However, the tensile strength and loop strength of this polymer is relatively poor when formed into a monofilament. The PPS material to be utilized in the present invention must be melt extrudable and should have a melt temperature range of between about 275° C. and 325° C. Examples of PPS which may be suitable for use in the present invention include, but are not necessarily limited to, PPS material available from Hoechst Celanese under the trade name and registered trademark Fortron and PPS material available from Phillips Chemical Co. under the trade name and registered trademark Ryton. A specific PPS suitable is SKX 228, available from Hoechst Celanese.

The polyamide material to be utilized in the present invention must also be melt extrudable and should have a melt temperature range of between about 190° C. and 300° C. Example of a particularly preferred polyamide which may be suitable for use in the present invention is type 66 nylon available from Monsanto Co. under the trade name and registered trademark Vydyne or from E.I. du Pont de Nemours, Co. under the trade name and registered trademark Zytel. Another example of a preferred polyamide suitable for use in the present invention is type 6 nylon such as may be commercially available from Allied Signal under the trade name and registered trademark Capron. It will be understood, however, that essentially any polyamide known in the art which meets the conditions of the present invention will be suitable. Thus, nylon 6, nylon 66, nylon 69, nylon 610, nylon 611, nylon 612, nylon 11, nylon 12, etc., and copolymers and blends of these are also believed to be suitable polyamides for the present invention.

In order to provide a compatibilized blend of the above materials, a compatibilizer must be used. Preferably, compatibilizers commonly referred to as chemically modified polyolefins or functionalized polyolefins are used. By the term "chemically modified" it is meant that the polyolefins have been chemically reacted with another material such as a functionalized monomer to provide a modified polyolefin having a functionalized group chemically attached to it. That is, such compatibilizers consist essentially of polyolefins such as, for example, polyethylene, polypropylene and ethylene-propylene-diene terpolymers (EPDM) which are grafted with various functional monomers, e.g., maleic anhydride and acrylic acid, via reactive extrusions. These materials are used as coupling agents for glass filled polyolefins and for blends of polyolefins and polyamides. It is known that maleic anhydride grafted polypropylene improves the dispersibility and mechanical strength of nylon 6/polypropylene blends. That these chemically modified polyolefins should also act to compatibilize blends of PPS and one or more polyamide resin is surprising and totally unexpected.

The compatibilizer to be utilized in the present invention must be melt extrudable and should have a melt temperature of about 200° C., although higher or lower temperatures may be useful depending upon the various component ratios and extrusion conditions. Examples of compatibilizers which may be suited for use in the present invention are grafted polypropylenes and grafted high density polyethylene, both available from the Uniroyal Chemical Co. under the trade name Poly-Bond. Other examples of compatibilizers include grafted ethylene-propylene-diene terpolymers (EPDMs) available from Uniroyal Chemical Co. under the trade name Royaltuf. A specific example of this particular type of compatibilizer is a maleic anhydride grafted EPDM sold under the trade name Royaltuf 465. Preferably, maleic anhydride or acrylic acid is grafted to the polyolefins.

To the extent that a compatibilizer is suitable for use in the present invention given the conditions set forth hereinabove, any compatibilizer may be used. However, it will be appreciated that the compatibilizer of the present invention is preferably devoid of monomeric substances and polymers containing epoxy groups and/or oxazolinyl groups since these materials are used to blend in a multiple step kneading process which process is not particularly desirable for the present invention. Thus, a compatibilizer containing maleic anhydride or acrylic acid by themselves, i.e., ungrafted to a polyolefin, is not desirable.

Also, the monofilaments of the present invention are preferably devoid of additional polymeric materials other than PPS and the polyamide resins. Specifically, the present invention should be devoid of other polymeric materials which are non-crystalline such as polyphenylene ethers, hydrogenated styrene-butadiene block copolymers and the like.

Preferably, the monofilaments include from about 25 to about 99 parts by weight polyphenylene sulfide and from about 75 to about 1 parts by weight of at least one polyamide, with from about 0.1 to about 10 parts by weight of the compatibilizer added to the blend to form 100 parts by weight of the blend. More preferably, less than about 80 parts by weight PPS and more than about 20 parts by weight polyamide are used, with amounts of the compatibilizers being from about 0.1 to about 5 parts by weight. Even more preferably, from about 45 to 55 parts by weight PPS and from about 45 to about 55 parts by weight polyamide are used, with about 1 to 3 parts by weight compatibilizer.

Compatibilized polymer blends of PPS and one or more polyamide resins may also be suitable for the production of products other than monofilaments as well. Notably, these compatibilized blends are believed to have improved mechanical/physical properties as compared to previous blends of PPS and other materials, including polyamides, which blends were not completely compatibilized. Because of the addition of the compatibilizer, these PPS/polyamide resin blends are able to maintain excellent mechanical/physical properties which, heretofore, could not be done, as noted in Akhtar and White hereinabove.

With respect to the extrusion process, the monofilament is produced by extruding the PPS and polyamide together with the compatibilizer resin. The PPS along with the polyamide and the compatibilizer resin may be mechanically mixed, the mixture being placed in the extruder hopper and from there, being fed into the extruder together. Alternatively, the polymeric materials and compatibilizer may be fed separately into the extruder. In any event, the melting and intimate blending of the resins forming the blended mixture takes place in the extruder at a temperature of about 290° C. as the screw conveys the blended resin mixture forward. The molten and thoroughly blended resin mixture is fed into a metering pump which forces the molten, substantially uniformly dispersed resins of the blended mixture through a die to form molten filaments. The extrusion temperature ranges between about 275° C. to 325° C. with 285° C. to 310° C. being preferred.

The molten monofilament is quenched in air or a water bath so that solid filaments are formed. The solid filaments are drawn at room or elevated temperatures at about 90° C.–200° C. between a set of draw rolls to a ratio of from about 3:1 to 6:1 and the drawn filaments are allowed to relax about 2–15% by passing them through a relaxing stage. The finished filaments are wound onto spools.

As noted above, blends of PPS and polyamides which are not compatibilized result in filaments having deficient physical properties. In particular, such blends have poor abrasion resistance, and as noted in Baker et al. U.S. Pat. No. 4,786,554, the polyamide content in the case of uncompatibilized blends must be limited to less than 20 weight percent. By the term "uncompatibilized" it is meant that the resin blend does not contain a third component compatible with both PPS and the other ingredient, namely polyamide resin, to allow for a thorough, uniform, substantially homogenous mixture to exist.

The effect of using a compatibilizer can be seen in the size of the die swell when the blends are extruded. "Die swell" is a common term used in the extrusion art to describe the phenomenon whereby the monofilaments increase or "swell" in diameter just after they have been extruded through the die. Die swell is caused by the incompatibility of resins when blended together. Typically, it is desirable that the monofilament not swell in diameter at all, but some monofilaments can be useful so long as they do not swell by more than twice their original diameter when being extruded. Blends of PPS and polyamide with no compatibilizers exhibit extremely large die swells when extruded into monofilaments. In fact, when greater amounts of polyamide is used, i.e., greater than about 20 weight percent, the die swell is so large that filaments cannot be formed at all, the diameter of the product swelling, in some instances, to over four times its original diameter. In contrast, blends of PPS and polyamides containing the compatibilizers of the present invention have minimal die swells, and more typically, do not swell in diameter at all when extruded. Thus, the filaments can be formed without difficulty.

The process for single step extrusion of the monofilaments of the present invention comprising PPS, polyamide and polyolefin compatibilizer blend has been described hereinabove. That is, the three components are placed in an extruder hopper, blended, melted and extruded through a die in one step. In addition, it is possible to use a two-step process whereby the polyamide is first blended with the compatibilizer using either a single screw extruder or a twin screw extruder to form pellets. The pellets, consisting of a polyamide and a compatibilizer, are then blended with PPS and extruded into filaments.

In order to demonstrate practice of the present invention, compatibilized blends of varying amounts of polyphenylene sulfide and polyamide resins were prepared and extruded into monofilaments according to the concepts of the present invention. Various tests were then conducted on the monofilaments to provide supporting evidence of the superiority of the monofilaments of the present invention as compared to other monofilaments. The examples provided hereinbelow are illustrative only and not meant to necessarily limit the invention, the invention being measured by the scope and spirit of the claims.

EXAMPLE 1

Eight blends of resins were prepared by mixing from about 75 to about 30 parts by weight PPS (Hoechst-Celanese, SKX 228), from 25 to about 70 parts by weight type 66 nylon (Monsanto, Vydyne 65A) and about 2 parts by weight maleic anhydride-grafted-polypropylene (Uniroyal, Poly-Bond 3002) in the amounts shown in Table I hereinbelow. Specifically and throughout the rest of the specification, the amount of polyphenylene sulfide is listed as the first numeral before the first slash symbol, the amount of polyamide is listed as the second numeral between the first and second slash symbol, and the amount of the compatibilizer is listed as the third numeral after the second slash symbol. All ingredients are listed in parts by weight unless otherwise specified.

The uniformly mixed blends were placed in the hopper of a 1.25-inch single screw extruder and extruded in a standard fashion. The extrusion conditions, which are not to be considered limiting, were as follows:

| | |
|---|---|
| First heater zone | 293° C. |
| Second heater zone | 296° C. |
| Third heater zone | 299° C. |
| Extruder neck | 290° C. |
| Extruder pump | 288° C. |
| Extruder head | 288° C. |
| Extruder die | 288° C. |

The extruder die had five, 1.39 mm holes. The extruder output was 5.56 kg/hour and the final monofilament size was about 0.50 mm. The monofilament was quenched in water at a temperature of about 65° C. The die to quench distance was about 7.6 cm, and the quenched monofilament was drawn in a water bath at about 90° C. at a ratio of about 3.8:1. The filament was passed through a 10% relax stage in a hot air oven at about 149° C. and was then placed on spools for testing.

For comparative purposes, polyphenylene sulfide (Hoechst-Celanese, SKX 228) was extruded without nylon into a monofilament using the same conditions outlined above, and this monofilament became the control sample. The filaments were then tested to evaluate their physical properties. The results of the testing are also presented in Table I.

More specifically, the tensile of the test samples was tested according to ASTM Method D-885. In addition, filament tensile retention after abrasion was determined by using an apparatus described below. The abrader consists of a horizontal hollow cylinder (25.5 cm dia.) with twelve carbon steel bars, (3.1 mm diameter, 60.5 cm long) equally spaced around the circumference of the cylinder. The filament to be tested was suspended with a weight so that it was in contact with five of the bars. The cylinder was rotated at 167 rpm in downward direction with respect to the hanging filaments. The size of the weight as well as the number of cycles was determined by the size of the filament. In the case of 0.5 mm filaments, a weight of 500 gm and 1500 cycles were used. Tensile after 1500 cycles was measured and compared to the non-abraded line. Percent retention is the ratio of the abraded tensile to the non-abraded tensile. Wet abrasion testing is essentially the same as dry, with the exception that the bars on the abrader are in contact with water at each revolution.

Loop impact was determined by forming two interlocking single loops and measuring the energy required to break one of the loops. The apparatus used consists of a weighted pendulum which swings through 180°. One loop was tied to the pendulum, the other loop was fastened to a stationary position on the apparatus. The pendulum was released from a horizontal position and fell through an arc so that a loop breaks. The maximum swing of the pendulum after a loop breaks was then recorded. From this maximum swing, the energy required to break the loop can be calculated.

TABLE I

COMPARISON OF MONOFILAMENT PROPERTIES
0.5 mm Filaments of
PPS/Nylon type 66/Maleic Anhydride Grafted Polypropylene

| Test Blend | Initial Tensile [lbs] | Tensile [lbs] (% Retention Dry)[a] | Tensile [lbs] (% Retention Wet)[a] | Loop Impact [ft. lb/in.] | Loop Strength [lbs] |
|---|---|---|---|---|---|
| 100/0/0 (Control) | 13.58 | 9.84 (72.5%) | 12.01 (88.4%) | 42.31 | 9.2 |
| 75/25/2 | 14.83 | 14.16 (95.5%) | 13.80 (93.1%) | 39.0 | 8.35 |
| 65/35/2 | 15.37 | 13.48 (87.7%) | 14.39 (93.6%) | 54.4 | 10.15 |
| 55/45/2 | 16.85 | 14.12 (83.8%) | 13.11 (77.8%) | 116.0 | 19.91 |
| 50/50/2 | 16.84 | 14.46 (85.9%) | 13.71 (81.4%) | 116.5 | 20.48 |
| 45/55/2 | 16.82 | 14.28 (84.9%) | 13.72 (81.6%) | 163.1 | 16.56 |
| 40/60/2 | 16.19 | 14.10 (87.1%) | 15.17 (93.7%) | 114.0 | 21.23 |
| 35/65/2 | 15.86 | 15.11 (95.3%) | 15.34 (96.7%) | 147.3 | 19.99 |
| 30/70/2 | 15.62 | 15.08 (96.5%) | 15.60 (99.9%) | 144.9 | 18.85 |

[a]After 1500 cycle abrasion.

Based upon these results, it is clear that the monofilaments comprising the compatibilized blends of the present invention have increased tensile strength and tensile retention after abrasion as compared to the monofilament which contained 100 parts by weight PPS. Furthermore, in almost every instance, loop impact and loop strength was greatly enhanced as compared to the control monofilament.

EXAMPLE 2

Next, additional compatibilized blends containing varying amounts of polyphenylene sulfide (Hoechst-Celanese, SKX228), type 66 nylon (Monsanto Vydyne, 65A) and maleic anhydride-grafted-polypropylene (Uniroyal Poly-Bond 3002) were prepared and extruded into monofilaments according to the procedure set forth in Example 1 hereinabove. In addition, a blend of about 98 parts by weight polyphenylene sulfide and about 2 parts by weight of a fluoropolymer, namely, polytetrafluoroethylene (PTFE), was prepared and extruded into a number of monofilaments. The PPS/PTFE monofilaments became the control monofilaments for this example. These filaments were then subjected to a variety of tests to evaluate their physical properties.

First, the tensile strength, percent elongation and loop strength of the monofilaments were tested at room temperature and at 350° F. (177° C.) by known methods such as those set forth in Example 1 hereinabove. Then, the monofilaments were submerged in water for 24 hours and the tensile, elongation, and loop strength were tested again to determine the impact moisture absorption would have on the monofilaments.

In another test, the monofilaments were submerged in water for a total of about 88 hours and the lengths of the monofilaments were tested. As noted hereinabove, it would be expected that monofilaments having large amount of nylon (polyamide) would change in length.

Finally, a rod abrasion test and sand paper abrasion test was performed on the monofilaments. The rod abrasion test involves passing a horizontally-oriented filament through a ceramic guide and allowing it to hang vertically while holding a weight. The horizontal end is moved back and forth (about 4 in.) so that abrasion occurs at the ceramic guide. The reciprocal motion continues until the filament splits.

The sand paper abrasion test involves suspending a weighted filament vertically so that it is in contact with a continuously moving sand paper strip. A reciprocating roller moves so that the filament moves up and down a length of 3" against the sand paper. Other rollers arrange the filament so that its contact with the sand paper is 1" long. The sand paper moves at a speed of 4" per min. in an upward direction with respect to the filament. The sand paper used is 1" wide with 320 J grit. The weight used on the filament is 250 gm. The test continues until the filament breaks.

The results of the various tests are presented in Table II.

TABLE II

COMPARISON OF MONOFILAMENT PROPERTIES
0.5 mm Filaments of
PPS/Nylon type 66/Maleic Anhydride Grafted Polypropylene

| | Monofilament (parts by weight) | | | |
|---|---|---|---|---|
| | PPS/PTFE (Control) | 65/35/2 | 45/55/2 | 40/60/2 |
| Initial Tensile, (lbs) | 15.54 | 16.06 | 16.32 | 16.25 |
| Elongation, % | 36.37 | 31.25 | 35.46 | 36.25 |
| Loop Strength (lbs) | 9.99 | 11.74 | 19.63 | 20.71 |
| Tensile 350° F. (lbs) | 10.82 | 11.00 | 11.04 | 10.81 |
| Loop Strength 350° F. (lbs) | 12.04 | 16.03 | 15.81 | 15.37 |
| Filaments Submerged in Water 24 Hrs. at 23° C. | | | | |
| Tensile (lbs) | 13.94 | 14.64 | 15.06 | 14.69 |
| Elongation, % | 31.11 | 30.54 | 39.71 | 37.63 |
| Loop Strength (lbs) | 7.87 | 9.93 | 20.44 | 19.16 |
| Filaments Submerged in Water 88 Hrs. at 23° C. | | | | |
| Length Change | — | No change | No change | +13.70% |
| Abrasion Testing | | | | |
| Dry Rod Abrasion (Cycles to Split) | 529 | 416 | 1600 | 1758 |
| Sand Paper Abrasion (Cycles to Break) | 84 | 48.4 | 87.6 | 98 |

The results of the test data shown in Table II clearly show that, after being submerged for 24 hours, the physical properties of the monofilaments of the present invention did not decrease significantly, and in some instances, unexpectedly increased.

With respect to the test for a change in length, it would be expected that a change in length would occur in the monofilaments of the present invention. Unexpectedly, however, in two of the three monofilaments tested, no change was detected.

Finally, as for the abrasion tests, it can be seen that the addition of greater than 50 parts by weight nylon and the compatibilizer significantly increased the abrasion resistance of the monofilament over that of the control monofilament.

EXAMPLE 3

In this example, various compatibilizers were tested and compared. In order to test the compatibilizers, a number of monofilaments were extruded from a compatibilized blend of about 45 parts by weight polyphenylene sulfide (Hoechst-Celanese, SKX 228), about 55 parts by weight type 66 nylon (Monsanto Vydyne 65A) and about 2 parts by weight of the various compatibilizers to be tested. The monofilaments were blended and extruded as set forth in Example 1 hereinabove as a single stage blend. The compatibilizers included Poly-Bond 3002, polypropylene grafted with maleic anhydride and designated in Table III below as PP-g-MA; Poly-Bond 3009, high density polyethylene grafted with maleic anhydride and designated as HDPE-g-MA; Poly-Bond 1001, polypropylene grafted with acrylic acid and designated as PP-g-AA; and Poly-Bond 1009, high density polyethylene grafted with acrylic acid and designated as HDPE-g-AA. All of the above compatibilizing materials are produced by and commercially available from Uniroyal Chemical Co. For comparison purposes, a filament was extruded from a composition comprising 100% PPS and having no compatibilizer. This monofilament was designated as a control.

Again, the tensile, loop impact and loop strength of the monofilaments were tested. In addition, the filament tensile after abrasion was determined as set forth in Example 1. The tensile retention was determined with the abrader being dry and wet.

Finally, in order to generally determine the degree of compatibility of the resins used for making the filaments, fibrillation was tested. Fibrillation refers to the fraying at the ends of the filaments after breaking. In general the more fibrillation, the lesser the degree of compatibility of the resins employed. The results of the above tests are shown in Table III.

TABLE III

COMPARISON OF COMPATIBILIZERS
0.5 mm Filaments of
45 pbw PPS/55 pbw Nylon type 66/2 pbw Compatibilizer
Single Stage Blending

| Tested Property | PP-g-MA | HDPE-g-MA | PP-g-AA | HDPE-g-AA | PPS (Control) |
|---|---|---|---|---|---|
| Initial Tensile [lbs] | 16.19 | 16.44 | 16.70 | 16.69 | 14.56 |
| Tensile [lbs] | 14.10 | 16.90 | 15.33 | 15.95 | 12.53 |
| (% Retention, Dry)[a] | (87.1%) | (102.8%) | (91.8%) | (95.6%) | (83.1%) |
| Tensile [lbs] | 15.17 | 16.56 | 16.29 | 16.08 | 12.13 |
| (% Retention, Wet)[a] | (93.7%) | (100.7%) | (97.5%) | (96.3%) | (83.3%) |
| Loop Impact [ft. lb/in.] | 163.10 | 132.0 | 155.8 | 126.0 | 33.67 |
| Loop Strength [lbs] | 21.23 | 22.36 | 20.29 | 21.91 | 11.06 |
| Fibrillation | Slight | V. Slight | Slight | Slight | — |

[a]after 1500 cycle abrasion.

From the results shown in Table III, it can be seen that each of the above-identified compatibilizers effectively improved the physical properties of the monofilaments as compared to the 100 parts by weight PPS monofilament (Control). Moreover, only slight or very slight fibrillation occurred upon breakage of the filaments. Thus, it is clear that each of the above-identified compatibilizers aid in the formation of a compatibilized blend of PPS and a polyamide resin.

EXAMPLE 4

Next, various tests were performed on monofilaments prepared via the two-stage blending process. In the first step of this two stage method, pellets containing a blend of about 55 parts by weight type 66 nylon (Monsanto, Vydyne 65A) and about 2 parts by weight of the various compatibilizers noted in Example 3 are formed using a Werner & Pfleiderer ZSK30 twin screw extruder. The nylon 66/compatibilizer blends were melted, extruded into strands and cut into the pellets. Then, in the second step, the nylon 66/compatibilizer pellet blends were mixed with PPS (Hoechst-Celanese, SKX 228) so that the resulting composition by weight was about 45 parts PPS, about 55 parts nylon 66, and about 2 parts compatibilizer (45/55/2). The mixtures were loaded into an extruder and were extruded using essentially the same extrusion procedure as set forth in Example 1. Three separate trials were carried out at differing extruder screw speed for the monofilaments containing maleic anhydride grafted polypropylene (PP-g-MA). Also, the control monofilament again contained 100 parts by weight PPS.

Comparison tests like those in Example 3 were then conducted to determine whether the compatibilizers were adequate for this extrusion process as well. The results of these tests are shown in Table IV.

TABLE IV

COMPARISON OF COMPATIBILIZERS
0.5 mm Filaments of
45 pbw PPS/55 pbw Nylon type 66/2 pbw Compatibilizer
Two Stage Blending

| Tested Property | PP-g-MA 100 rpm[a] | PP-g-MA 200 rpm[a] | PP-g-MA 300 rpm[a] | HDPE-g-MA | PP-g-AA | HDPE-g-AA | PPS[b] (Control) |
|---|---|---|---|---|---|---|---|
| Initial Tensile [lbs] | 15.90 | 16.75 | 16.11 | 16.68 | 18.13 | 16.21 | 14.56 |
| Tensile [lbs] | 13.99 | 12.91 | 11.40 | 16.51 | 16.29 | 15.38 | 12.53 |
| (% Retention, Dry)[c] | (88%) | (77.0%) | (70.8%) | (99%) | (89.9%) | (94.9%) | (86.1%) |
| Tensile [lbs] | 14.37 | 14.74 | 14.94 | 15.18 | 15.94 | 15.29 | 12.13 |
| (% Retention, Wet)[c] | (90.4%) | (88%) | (92.7%) | (91%) | (87.9%) | (94.3%) | (83.3%) |
| Loop Impact [ft. lb/in] | 185.8 | — | — | 127.5 | 133.1 | 123.4 | 33.67 |
| Loop Strength [lbs] | 24.18 | 18.96 | 19.52 | 23.52 | 20.14 | 19.71 | 11.06 |
| Fibrillation | Slight | Slight | Slight | Very Slight | Severe | Severe | — |

[a]Extruder Screw Speed
[b]A single screw extruder was used. This should have little or no effect on the physical properties tested.
[c]After 1500 cycle abrasion As can be seen from the Table above, each of the above-identified compatibilizers again effectively improved or maintained the physical properties of the monofilaments as compared to the 100 parts by weight PPS monofilament (Control). As for fibrillation, the monofilament composition containing polyolefins grafted with maleic anhydride had only slight or very slight fibrillation occur upon breakage of the filaments. However, the monofilaments containing compatibilizers using acrylic acid as the functionalized group show severe fraying and fibrillation. Thus, for this particular method of blending, it is clear that acrylic acid functional groups should preferably be avoided for these particular blends of PPS and a polyamide resin.

EXAMPLE 5

In this example, about 45 parts by weight polyphenylene sulfide (Hoechst-Celanese, SKX228) was again blended with about 55 parts by weight of type 66 nylon and about 2 parts by weight maleic anhydride grafted polypropylene (Uniroyal Poly-Bond 3002). However, this time, two nylons prepared by separate commercial entities were used. Specifically, the type 66 nylon were Vydyne 65A available from Monsanto, and Zytel 103HS, available from E.I. du Pont de Nemours. Monsanto's Vydyne 65A has a relative viscosity of about 120 RV, while Zytel 103HS has a relative viscosity of 50 RV. RV was determined according to ASTM D-789.

The blends were again extruded according to the process set forth in Example 1 to form monofilaments, and the physical properties of the resulting filaments were tested. The results are shown in Table V-A hereinbelow.

TABLE V-A

COMPARISON OF TYPE 66 NYLONS
Filaments of
45 pbw PPS/55 pbw Nylon type 66/2 pbw Compatibilizer

| | Vydyne | Zytel |
|---|---|---|
| Initial Tensile, [lbs] | 16.19 | 15.93 |
| Tensile, [lbs] | 14.10 | 14.48 |
| (% Retention)[a] | (87.1%) | (90.9%) |
| Tensile, [lbs] | 15.17 | 14.45 |
| (% Retention)[a] | (93.7%) | (90.7%) |
| Loop Impact [ft.lb/in] | 163.10 | 119.1 |

TABLE V-A-continued

COMPARISON OF TYPE 66 NYLONS
Filaments of
45 pbw PPS/55 pbw Nylon type 66/2 pbw Compatibilizer

| | Vydyne | Zytel |
|---|---|---|
| Loop Strength [lbs] | 21.23 | 18.75 |
| Fibrillation | Slight | Slight |

[a]After 1500 cycle abrasion.

In addition to the above physical property tests, which results are substantially the same for either of the nylons employed, the monofilaments prepared in accordance with the present invention were also subjected to thermal aging tests in hot, dry air. In one test, the test monofilaments were dry heat aged at 197° C. for 5 consecutive days. The data in Table V-B show the results of these thermal aging tests. Data are shown as percent tensile strength retained.

TABLE V-B

COMPARISON OF TYPE 66 NYLONS
Filaments of
45 pbw PPS/55 pbw Nylon type 66/2 pbw Compatibilizer
Dry Heat Aged at 197° C. for 5 Days

| | Percent Tensile Retention of Monofilaments Containing | |
|---|---|---|
| Days | Zytel 103HS | Vydyne 65A |
| 0 | 100.0% | 100.0% |
| 1 | 93.2% | 88.0% |
| 2 | 87.9% | 84.3% |
| 3 | 82.6% | 79.6% |
| 4 | 80.2% | 76.2% |
| 5 | 76.8% | 72.8% |

In another test, the monofilaments were dry heat aged at 177° C. (350° F.) for 15 consecutive days. In addition to the two monofilaments prepared according to the concepts of the present invention, another monofilament was extruded from 100 parts by weight polyethylene terephthalate (PET). A comparison of the dry heat results of the monofilaments comprising the blends of the present invention and the control PET monofilament are presented in Table V-C hereinbelow.

TABLE V-C

COMPARISON OF TYPE 66 NYLONS
Filaments of
45 pbw PPS/55 pbw Nylon type 66/2 pbw Compatibilizer
Dry Heat Aged at 177° C. for 15 Days

| | Percent Tensile Retention of Monofilaments Containing | | |
|---|---|---|---|
| Days | Zytel 103HS | Vydyne 65A | PET only (Control) |
| 2 | 93.7% | 95.5% | 93% |
| 4 | 91.3% | 88.6% | 85.8% |
| 7 | 87% | 86.6% | 79% |
| 9 | 87% | 81.4% | 75.2% |
| 12 | 86.8% | 78.3% | 69% |
| 15 | 83.7% | 73.1% | 64.2% |

As shown in Table V-C, the monofilaments of the present invention are much more thermally stable than the PET monofilament (Control). Furthermore, as shown in the FIGURE, the dry heat stability of a monofilament of the present invention is compared to the dry heat stability of monofilaments of unblended PET and unblended nylon 66 at 177° C. (350° F.) for 50 days. The PPS/Nylon 66/Compatibilizer formulation of the present invention was a 45/55/2 parts by weight blend and is designated as a "PPS Alloy" in the graph. As can be seen the monofilament containing 100 percent Nylon 66 lost all tensile after less than 25 days. The PET monofilament lost all of its tensile after slightly more than 40 days. However, the monofilament of the present invention still retained more than 40 percent tensile even after 50 days under the extreme dry heat conditions noted above. Thus, it is clear that the monofilaments of the present invention are much more thermally stable than not only the PET monofilament, but also monofilament containing 100 parts polyamide.

EXAMPLE 6

Again, polyphenylene sulfide (Hoechst-Celanese, SKX 228), type 66 nylon (Monsanto, Vydyne 65A) and maleic anhydride grafted polypropylene (Uniroyal, Poly-Bond 3002) were blended and then extruded according to the process set forth in Example 1 and in the amounts provided in Table VI hereinbelow (based upon parts by weight). In addition, a control monofilament consisting of 100 parts by weight PET was prepared. The resulting filaments were hydrolyzed with steam at 15 psi (119° C.) over 15 days. The tensile retention of the filaments was determined every 2 or 3 days. The hydrolysis results are shown in Table VI.

TABLE VI

COMPARISON OF
MONOFILAMENT TENSILE RETENTION PROPERTY
Filaments of
PPS/Nylon type 66/Maleic Anhydride Grafted Polypropylene
(parts by weight) Hydrolyed with Steam at 15 psi (119° C.) for 15 Days

| | Percent Tensile Retention After Hydrolysis | | | | |
|---|---|---|---|---|---|
| Days | 75/25/2 | 50/50/2 | 25/75/2 | 45/55/2 | 100 parts PET |
| 2 | 89.5% | 94.7% | 91.3% | 96.2% | 95.2% |
| 5 | 89.3% | 94.3% | 92.7% | 93.0% | 93.6% |
| 7 | 84.7% | 90.2% | 88.9% | 86.9% | 93.4% |
| 9 | 90.7% | 89.8% | 85.7% | 93.3% | 88.9% |

TABLE VI-continued

COMPARISON OF
MONOFILAMENT TENSILE RETENTION PROPERTY
Filaments of
PPS/Nylon type 66/Maleic Anhydride Grafted Polypropylene
(parts by weight) Hydrolyed with Steam at 15 psi (119° C.) for 15 Days

| | Percent Tensile Retention After Hydrolysis | | | | |
|---|---|---|---|---|---|
| Days | 75/25/2 | 50/50/2 | 25/75/2 | 45/55/2 | 100 parts PET |
| 12 | 87.1% | 87.3% | 78.5% | 91.0% | 50.1% |
| 15 | 75.9% | 85.1% | 78.6% | 88.6% | 16.1% |

The results shown in Table VI clearly demonstrate that the monofilaments of the present invention are much more hydrolytically stable than conventional monofilaments prepared from PET.

EXAMPLE 7

In this example, 45 parts by weight PPS (Hoechst-Celanese, SKX 228) was blended with 55 parts by weight type 66 nylon (Monsanto, Vydyne 65A) and 2 parts by weight of one of several types of compatibilizers and extruded according to the procedure set forth in Example 1. The compatibilizers are the same as were previously identified in Example 3 hereinabove. The dry heat resistance of the prepared filaments was then determined and compared to results obtained by subjecting a PET monofilament to the same conditions, i.e., 177° C. (350° F.) for 15 days. The results are shown in Tables VII.

TABLE VII

COMPARISON OF COMPATIBILIZERS
Filaments of
45 pbw PPS/55 pbw Nylon type 66/2 pbw Compatibilizer
Dry Heat Aged at 177° C. for 15 Days

| | Percent Tensile Retention for Monofilaments Containing | | | | |
|---|---|---|---|---|---|
| Days | PP-g-AA | HDPE-g-AA | HDPE-g-MA | PP-g-MA | PET (Control) |
| 2 | 99.7% | 98.8% | 98.5% | 95.5% | 93.0% |
| 4 | 93.8% | 90.6% | 99.9% | 88.6% | 85.8% |
| 7 | 88.0% | 91.6% | 91.2% | 86.6% | 79.0% |
| 9 | 87.8% | 89.4% | 91.7% | 81.4% | 75.2% |
| 12 | 84.2% | 89.3% | 88.1% | 78.3% | 69.0% |
| 15 | 80.1% | 83.7% | 84.8% | 73.1% | 64.2% |

Given these results, it should be evident that each of the above-tested compatibilizers in the formulation of the present invention enable the monofilament prepared from the compatibilized blends noted above to exhibit excellent dry heat resistance, especially as compared to PET monofilaments (Control).

EXAMPLE 8

In this example, monofilaments were prepared from blends of PPS (Hoechst-Celanese, SKX 228), nylon type 6 (Allied Signal, Capron) and maleic anhydride grafted polypropylene (Uniroyal, Poly-Bond 3002) according to the procedure set forth in Example 1. For purposes of comparison, a filament was extruded from a composition comprising 100% PPS and having no compatibilizer or nylon. This monofilament was designated as a control.

Again, the tensile and loop strength of the monofilaments were tested, the results of which are reported in Table VIII hereinbelow. The tensile and loop strength of the monofilaments are reported in grams per denier in this example. To calculate this, the tensile strength (lbs) is multiplied by 454 and then divided by the denier of the filament.

TABLE VIII

COMPARISON ON MONOFILAMENT PROPERTIES
Filaments of
PPS/Nylon type 6/Maleic Anhydride Grafted Polypropylene

| | Monofilament Composition (parts by weight) | | |
|---|---|---|---|
| | 45/55/2 | 55/45/2 | 100 parts PPS |
| Tensile (g/denier)[a] | 3.68 | 3.74 | 2.89 |
| Loop Strength (g/denier)[a] | 2.44 | 2.41 | 1.86 |

[a]Reported in grams per denier which is calculated by multiplying tensile strength (lbs.) by 454 and dividing by the filament denier.

Clearly, the monofilaments of the present invention exhibit superior physical properties as compared to the control PPS monofilament, even when the type of polyamide resin is changed.

EXAMPLE 9

Finally, a number of monofilaments were extruded from a compatibilized blend of about 45 parts by weight polyphenylene sulfide (Hoechst-Celanese, SKX 228), about 55 parts by weight type 6 nylon or type 6,6 nylon, and about 2 parts by weight of maleic anhydride grafted ethylene-propylene-diene terpolymer (EPDM) (Uniroyal, Royaltuf 465). The monofilaments were blended and extruded as set forth in Example 1 hereinabove as a single stage blend. Again, tensile and loop strength were tested, as well as percent tensile retained after abrasion using a dry abrader. A 100% PPS monofilament was used as the control monofilament. The results of these tests are reported in Table IX hereinbelow.

TABLE IX

COMPARISON OF MONOFILAMENT PROPERTIES
Filaments of
45 pbw PPS/55 pbw Nylon/2 pbw Maleic Anhydride Grafted EPDM

| | Nylon 6 | Nylon 6,6 | 100 parts PPS |
|---|---|---|---|
| Tensile (g/denier) | 3.35 | 3.07 | 2.89 |
| Loop Strength (g/denier) | 3.32 | 3.73 | 1.86 |
| % Tensile Retained, Dry | 89% | 82,8% | 86.1% |

As shown in Table IX, the use of monofilaments of the present invention having other suitable compatibilizers and polyamides will exhibit superior physical properties as compared to the control PPS monofilament.

The monofilament blends described herein could be readily woven into a fabric which would be suitable for a variety of industrial purposes including use as a belt for paper making machines.

The fabric referred to herein is typically formed by weaving two filament systems, i.e., lengthwise yarn (warp) and crosswise yarn (fill), at least one of which is a monofilament system, in a repeated pattern. Possible patterns include the plain weave in which the filling yarn passes alternately over and under each warp yarn, the twill weave which is formed by interlacing warp and fill so that the filling yarn passes alternately over and under two or more warp yarns, and the satin weave which is formed so that there are more filling yarns on the face than on the inside of the fabric. Variations of these patterns are possible which include combinations of the basic patterns. In addition to these one layer fabrics, fabrics can be woven having two or more layers.

As will be appreciated by those skilled in the art, fabrics can be woven flat and then seamed to form an endless belt or can be woven as an endless belt so that no seam is necessary. It is to be understood that the monofilament of this invention can be used for part or all of the filaments in any of the fabrics described hereinabove.

One suggested use for the fabrics of the present invention is in the paper industry where fabrics were originally made from metal wires. Metal wire fabrics have been largely replaced by fabrics made from synthetic materials such as polyester and nylon because the synthetic materials result in longer life-times for the belts. In some environments, i.e., where high temperatures and corrosive chemicals are present, the ordinary synthetics are not suitable. For this reason materials such as PPS, which have good chemical and temperature resistance, have been used with success in hostile environments. However, as discussed above, PPS is expensive and, by itself, is difficult to work with because of its brittleness. Fabrics prepared from the compatibilized blends discussed herein have been constructed with no difficulty and have, therefore, substantially eliminated the problems encountered with PPS monofilaments/fabrics.

The known fabrics described hereinabove have been used for the most part on paper forming machines. In these instances, the fabrics are formed into endless belts which are in continuous motion on the paper machine as the paper is formed. It is to be understood that such fabrics also have applications for filter media in situations where the fabric is stationary. The fabrics described in the present invention are preferably prepared from filaments with diameters ranging from about 5 mils to 60 mils and have dimensions ranging from 100 to 400 inches wide (254 to 1016 cm) and from 100 to 300 feet long (30.5 to 91.5 m). As indicated above, part of the fabric can comprise the novel monofilament, as warp or fill, or the fabric can be totally manufactured from the novel monofilament (warp and fill). Fabrics of this invention can be utilized on paper forming machines, as filter media and other applications.

The monofilaments of the present invention are also suitable and can be made into spiral yarns which may then be linked or otherwise made into fabrics. Specifically, these spiral yarns can be made into spiral fabrics by linking together the lengths of spiraled filaments.

In conclusion, it should be clear from the foregoing examples and specification disclosure that the monofilaments of the present invention exhibit improved hydrolytic, thermal, chemical and physical properties as compared to unblended polyphenylene sulfide monofilaments, unblended polyamide monofilaments, and monofilament of uncompatibilized blends of polyphenylene sulfide and other conventional materials such as PTFE, PET, nylon, and the like. In particular, tensile after abrasion and loop strength of the monofilaments of the present invention are improved as compared to 100% PPS monofilaments, while thermal stability is improved as compared to 100% polyamide monofilaments.

It is to be understood that the present invention is not limited to the polyphenylene sulfides, polyamides and compatibilizers used in the examples above, and that the examples have been provided merely to demonstrate practice of the subject invention. Those skilled in the art may readily select other polyamides and/or chemically modified polyolefins according to the disclosure made hereinabove.

Similarly, practice of the process of the present invention should not be limited to a particular extruder, extrusion temperatures, quench temperatures, draw ratio or relaxation ratio from the exemplification it being understood by those skilled in the art that accommodations can be made within the spirit of the invention for differences in equipment as well as in the desired composition and physical properties of the monofilament. Furthermore, it will be understood that monofilaments of the present invention may have any shape or size suitable for use in producing the products desired. Thus, the monofilaments may have various cross-sectional dimensions and shapes without necessarily departing from the scope of the present invention.

Lastly, it should be appreciated that the monofilaments described herein shall have utility in woven fabric as well as in end-products made therefrom such as paper making belts. Both fabric and related end-products shall have improved physical properties such as temperature and chemical resistance over conventional fabrics composed of nylon and polyester filaments that have been utilized heretofore in similar embodiments.

Thus, it is believed that any of the variables disclosed herein can readily be determined and controlled without departing from the scope of the invention herein disclosed and described. Moreover, the scope of the invention shall include all modifications and variations that fall within the scope of the attached claims.

What is claimed is:

1. An extruded monofilament formed by a compatibilized polymer blend comprising:

from about 25 to about 99 parts by weight of a polyphenylene sulfide;

from about 75 to about 1 parts by weight of at least one polyamide resin; and from about 0.1 to about 10 parts by weight of a compatibilizer comprising a polyolefin grafted with a monomer selected from the group consisting of maleic anhydride and acrylic acid.

2. An extruded monofilament, as set forth in claim 1, wherein said polyamide resin is selected from the group consisting of nylon 6, nylon 66, nylon 69, nylon 610, nylon 611, nylon 612, nylon 11, nylon 12 and copolymers and blends thereof.

3. An extruded monofilament, as set forth in claim 2, wherein said polyamide resin is nylon 66.

4. An extruded monofilament, as set forth in claim 1, wherein said grafted polyolefin is selected from the group consisting of polyethylene, polypropylene, and ethylene-propylene-diene terpolymers.

5. An extruded monofilament, as set forth in claim 1, wherein said polyphenylene sulfide, polyamide resin, and compatibilizer are melt extrudable.

6. An extruded monofilament, as set forth in claim 1, wherein said compatibilized polymer blend includes less than 80 parts by weight of said polyphenylene sulfide and more than 20 parts by weight of said polyamide resin.

7. An extruded monofilament, as set forth in claim 1, wherein said compatibilized polymer blend includes from about 45 to 55 parts by weight of said polyphenylene sulfide; from about 45 to 55 parts by weight of said polyamide resin; and from about 1 to 3 parts by weight of said compatibilizer.

* * * * *